US006616296B1

(12) United States Patent
Roux et al.

(10) Patent No.: US 6,616,296 B1
(45) Date of Patent: Sep. 9, 2003

(54) FLASH-LIGHT WITH TUBULAR CASE COMPRISING A SAFETY SYSTEM MANAGED BY A MICROPROCESSOR

(75) Inventors: François Roux, Ris-Orangis (FR); Thierry Cassan, 7, allee Daumier, Courcouronnes (FR), F-91080

(73) Assignee: Thierry Cassan, Courcouronnes (FR)

( * ) Notice: Subject to any disclaimer, the term of this patent is extended or adjusted under 35 U.S.C. 154(b) by 0 days.

(21) Appl. No.: 09/889,071

(22) PCT Filed: Dec. 31, 1999

(86) PCT No.: PCT/FR99/03328

§ 371 (c)(1),
(2), (4) Date: Sep. 24, 2001

(87) PCT Pub. No.: WO00/42350

PCT Pub. Date: Jul. 20, 2000

(30) Foreign Application Priority Data

Jan. 12, 1999 (FR) ..... 99 00216

(51) Int. Cl.[7] ..... F21V 33/00

(52) U.S. Cl. ..... 362/184; 362/202; 362/205; 362/207; 362/208

(58) Field of Search ..... 362/184, 202, 362/205, 207, 208, 200, 201; 340/636

(56) References Cited

U.S. PATENT DOCUMENTS 3,873,957 A * 3/1975 Wurscher et al. ..... 137/389
4,048,631 A * 9/1977 Flores ..... 340/321
4,803,605 A * 2/1989 Schaller et al. ..... 362/184
5,272,606 A 12/1993 Blaney ..... 362/157
5,558,430 A 9/1996 Booty ..... 362/184
6,184,794 B1 * 2/2001 Tucholski ..... 324/426

FOREIGN PATENT DOCUMENTS

DE 33 12 600 10/1984
GB 2 207 744 2/1989

* cited by examiner

*Primary Examiner*—Sandra O'Shea
*Assistant Examiner*—Guiyoung Lee
(74) *Attorney, Agent, or Firm*—Baker & Daniels

(57) ABSTRACT

The invention concerns a flash-light comprising a control membrane, one or several reserve batteries (20), an emergency lighting (22), display means, and a managing electronic circuit comprising: means for controlling the level of the batteries to display their charge level and switch the battery or batteries (20) on the emergency bulb (22) if the main bulb is connected but the level of the cells (12) is insufficient; means for controlling the bulb, the circuit displaying the bulb condition (in order/out of order) or a charge level of the batteries (12) when the flash-light is on; means for controlling the charge level of the battery or batteries (20) to connect the battery or batteries (20) on the cells (12) and for recharging it or them if the level of the battery or batteries (20) is insufficient, said supply being interrupted as soon as the level of the battery of batteries (20) is above a threshold.

6 Claims, 3 Drawing Sheets

Figures 1, 2, 3, 4:
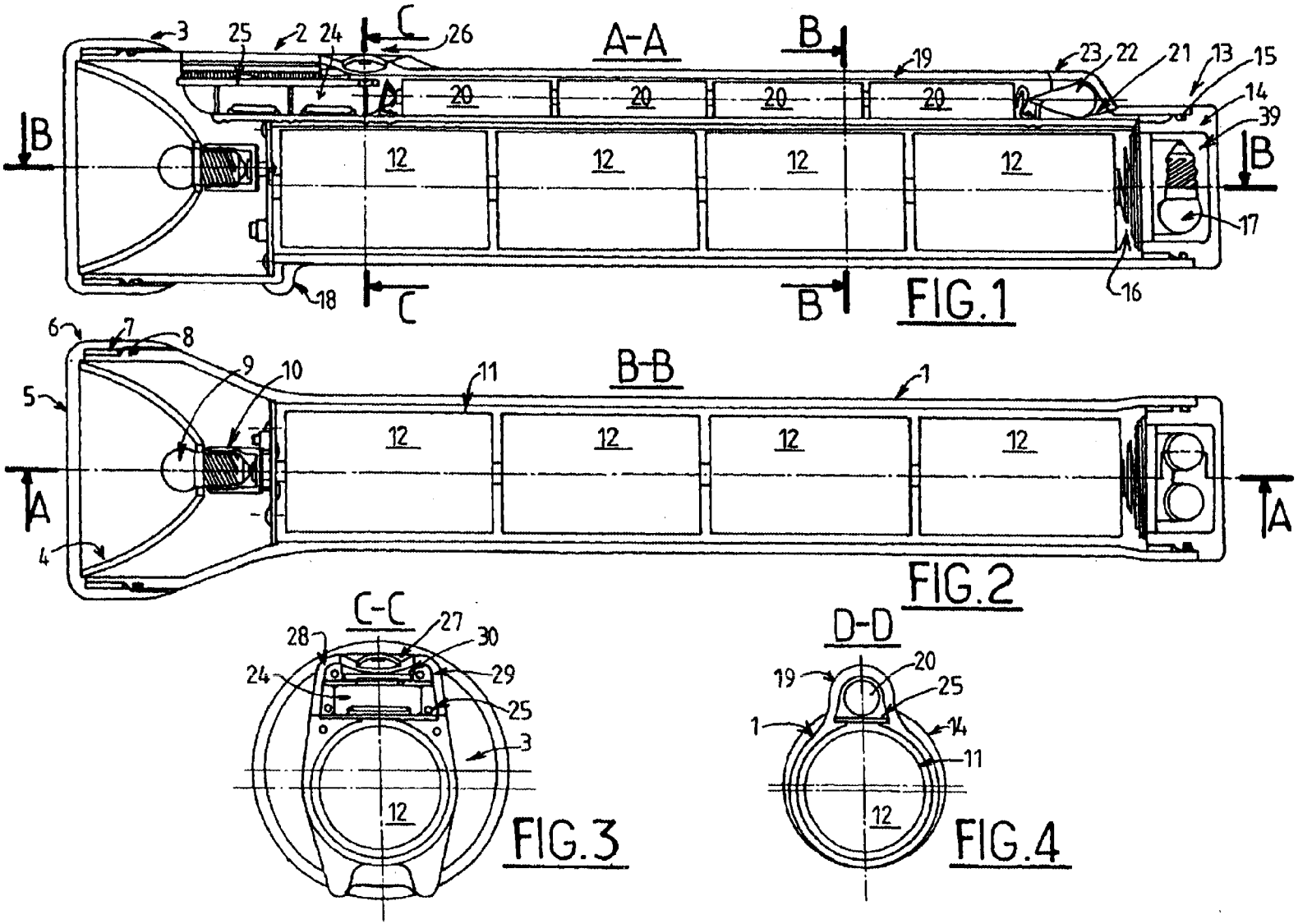

A-A
B-B
C-C
D-D

FLASH-LIGHT WITH TUBULAR CASE COMPRISING A SAFETY SYSTEM MANAGED BY A MICROPROCESSOR

The present invention relates to a flash-light with a tubular case of which one end accommodates an optical unit with a reflector of the parabolic type and a bulb placed substantially at the focus, wherein the reflector may be adjustable with respect to the bulb, as well as an assembly of batteries accommodated in the body of the case, behind the bulb.

There are numerous designs of flash-lights corresponding to the above definition. These flash-lights generally have the drawback that their operation is unpredictable in that they do not enable the situation to be known regarding the charge level of batteries which can fail suddenly. The same applies to the bulb which may be failing. The user is then obliged to carry out tests and first of all, if he thinks of it, to dismantle the optical unit in order to remove the bulb, possibly to check its condition if that is visible, to replace is and to carry out new tests then change the batteries. A user and above all a professional using a flash-light cannot always have with him the necessary replacement batteries, all the more so since a usual flash-light contains an assembly of several round batteries of an appropriate type. Such batteries are cumbersome when they are outside the flash-light case. They are also relatively heavy.

According to the document GB 2 207 744 a flash-light is known which is composed of two separate systems: a main system and a reserve system. Each system includes a bulb and one or more batteries. The user can switch over to the reserve system in the even of failure of the main system. The solution according to this document has a number of drawbacks such as the bulk and the weight. Moreover, since the two systems are strictly separated the aforementioned drawbacks are cumulative.

The aim of the present invention is to develop a flash-light of the type defined above which makes it possible at any moment to know its operating possibilities whilst offering automatic emergency operation in the event that this becomes necessary.

To this end the invention relates to a flash-light of the type defined above, characterised in that it comprises:

- a control membrane,
- one or more emergency batteries,
- emergency lighting,
- display means,
- a managing electronic circuit comprising:
  - means for monitoring the level of the cells to display their charge level and to switch the battery or batteries to the emergency bulb if the main bulb is connected but the level of the cells is insufficient,
  - means for monitoring the bulb, the managing circuit displaying the condition of the bulb (in order/out of order) or a charge level of the cells when the flash-light is on,
  - means for monitoring the charge level of the battery or batteries in order to connect the battery or batteries to the cells and to recharge it or them if the level of the battery or batteries is insufficient, this supply being interrupted as soon as the level of the battery or batteries is above a threshold.

The user of the flash-light equipped with cells or rechargeable batteries can at any moment know the condition and the possibilities of his flash-light, that is to say the condition of the bulb (whether the latter is out of order or in operating order) and whether the charge level of the cells is sufficient for the envisaged operation. When the cells are replaced by rechargeable batteries the charge level of the batteries will be indicated under the same conditions.

Moreover, following use which goes beyond the normal possibilities of the cells the emergency or substitute lighting is immediately implemented in so far as the user had switched on the normal flash-light bulb. This substitute lighting is substituted at least partially for the normal lighting. It also makes it possible to carry out replacement of a bulb if the normal bulb is out of order. This lighting also permits the replacement of the cells if they are drained and the user has replacement cells. It is also possible for the user to utilise the emergency lighting at the same time as the normal lighting, this double use permitting "ambient" lighting.

According to other advantageous characteristics of the invention:

- the control membrane covers a contactless Hall effect or lamellar switch, that is to say a magnetically tripped contactor still known as an ILS,
- the case above the tubular body, in the part accommodating the cells, an elongated projection which permanently accommodates the battery or batteries and the emergency bulb,
- the projection which accommodates the battery or batteries has a transparent or translucent part behind which the emergency bulb is located,
- the managing electronic circuit and the various display means as well as the control membrane of the switch are provided in a part of the case situated substantially behind the reflector and above the corresponding end of the cell compartment, and integrated in the external contour of the optical unit.

Figure 5:
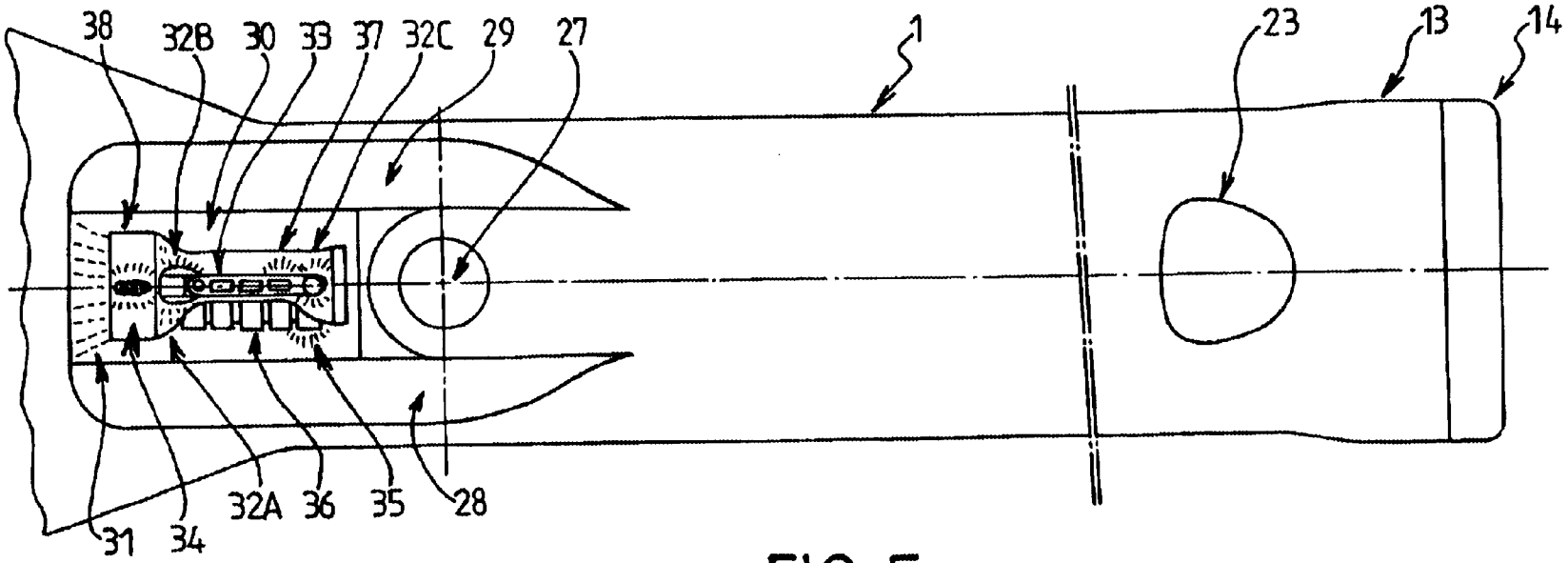
Figure 6:
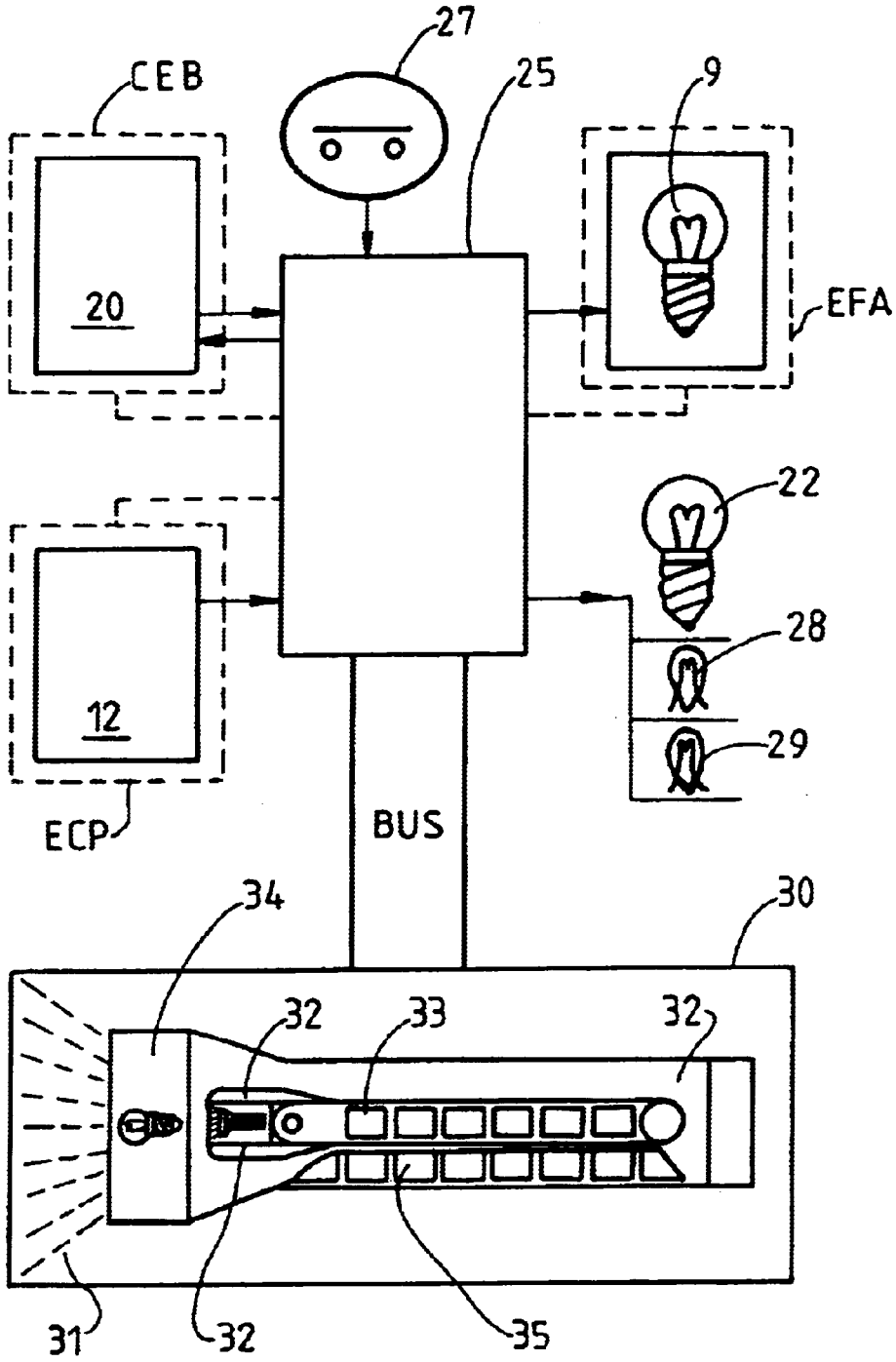

The present invention will be described below in greater detail with the aid of the accompanying drawings, in which:

FIG. 1 is a vertical longitudinal sectional view of a flash-light according to the invention, FIG. 2 is a horizontal longitudinal sectional view of the flash-light, FIG. 3 is a sectional view along the line C—C in FIG. 1, FIG. 4 is a sectional view along the line D—D in FIG. 1, FIG. 5 is a top view of a flash-light according to the invention, FIG. 6 is a block diagram of the electric/electronic circuit of the flash-light according to the invention.

According to FIGS. 1 to 4, the flash-light according to the invention is composed of a case 1 which overall is of tubular shape with at its front end 2 a part with a larger diameter accommodating an adjustable optical unit 3 formed by a substantially parabolic reflector 4 which is closed at the front by a glass 5 and placed in a ferrule 6 screwed onto the threaded front end 7 of the body with a gasket 8 interposed. The screw thread has a relatively large pitch in order to permit displacement in translation of the optical unit 3 and modification of the beam (parallel beam, convergent beam, divergent beam). The optical unit also comprises a bulb 9 placed in a fixed compartment 10 which is integral with the case. In normal conditions the bulb 9 or its filament is preferably located substantially in the focus of the parabolic reflector 4 so that the flash-light emits a beam of parallel rays. However, this beam can be transformed into a divergent beam or a convergent beam according to the position of the bulb with respect to the focus.

This bulb 9 can be a normal bulb or a halogen bulb.

Behind the optical unit and the bulb support there is located a compartment 11 for cells 12. These cells are cylindrical elements of circular cross-section; they are placed in contact one behind the other.

At the rear 13 the body 11 has a cap screwed on with an O-ring 15 interposed in order to close off the case 1 and seal it. The cap 14 applies a contact spring 16 against the base of the last cell 12. The cap 14 also accommodates one or more replacement bulbs 17.

Above the rear part 13 of the cell compartment 11 is located a projection 19 which forms a compartment for the battery or batteries 20. In the present case there are four circular cylindrical batteries of small dimensions which are aligned with one another. The rear of this compartment 19 forms a cavity 24 containing an emergency bulb 22 which is supplied by the batteries 20 under conditions which are defined below. This cavity 24 has a reflector 21 and the upper part of the case 23 at the level of the emergency bulb is transparent or at least translucent.

According to FIGS. 1 and 5, in the front part of the case 1, between the part accommodating the optical unit and the elongated projection permanently containing the batteries and the emergency bulb, there is located the compartment 28 containing a managing electronic circuit and the micro-lamps 29 as well as, on the top, a surface 30 with the control means and the display means preferably using liquid crystals. These control and display means are formed by a control membrane 27 permitting the flash-light to be put into operation and display means which indicate the condition of the lamp by pictograms on a screen preferably displayed using liquid crystals 30. Towards the front of the screen 30 is located the pictogram 34 for the condition of the bulb 9 indicating whether this bulb is capable of functioning or whether it is out of order. This condition relates to the main bulb 9 with which the optical unit is equipped.

There is also, amongst others, the pictogram 36 which indicates the charge level of the cells 12.

According to the invention, the membrane 27 covers a contactless Hall effect or lamellar button which is tripped magnetically. This button is formed by a magnetised element, displacement of which closes a Hall contact connected to the managing circuit 29. This closure of the contact generates a pulse which, via the managing circuit, controls the switching on or switching off of the lamp.

The top view in FIG. 5 shows clearly an example of distribution and arrangement of the various pictograms on a display preferably using liquid crystals.

FIG. 6 is a block diagram of the managing electronic circuit and of the peripheral elements.

This electronic circuit for example in the form of an electronic card with a microprocessor and a management program contained in a read-only memory ROM (which are not shown) is connected by the contactless switch to the cells 12 and the battery 20 as well as to the main bulb 9 and the emergency bulbs 22, 28, 29 as well as to the display 30, 38. Modes of operation of the flash-light comprising a safety system managed by a microprocessor:

Three modes of operation are available to the user:

Normal, Ambient and Morse. This means that the user makes a selection by one, two or three presses on the control membrane 27 during starting of the apparatus. The emergency mode is not a mode of operation but is a consequence of the test result.

Normal mode of operation:

One press for example exerted on the control membrane 27 will permit the starting of the lamp and thus, inter alia, of changing to Normal mode, that is to say switching on of the main lighting of the bulge 9 supplied by the cells or batteries 12, which will give rise to the automatic cutting-in of a succession of tests and of the managing system. This will bring about the display or lack of display of the results in the form of pictograms 31, 32, 32A, 32B, 32C, 33, 34, 35, 36, 37, on the pictogram 38, representing a symbolic view of the flash-light which will itself be a screen-printing on the screen 30 preferably displayed using liquid crystals.

In the course of operation in Normal mode different tests constituting the test procedure are carried out and give rise to the corresponding displays, that is to say:

The automatic cutting-in in loops, and until the flash-light is completely extinguished, of the test of a prolonged pressure exerted on the control membrane 27 which will make it possible to know whether or not the user wishes to extinguish his apparatus. This condition relates to the test of a prolonged pressure on the membrane 27, of three seconds for example.

The automatic cutting-in in loops, until the flash-light is completely extinguished, of the test indicating whether the condition of the bulb 9 of the main lighting is out of order, symbolised by the display or lack of display of the pictogram 34 on the display 30. This condition relates to the condition of the bulb 9 with which the main optical unit is equipped.

The automatic cutting-in in loops, until the flash-light is completely extinguished, of the test of the power remaining in the cells or batteries 12 symbolised by the display or lack of display of the pictogram 36 on the screen 30, indicating by 20% blocks the level of power remaining in the cells or batteries 12 supplying the bulb 9 of the main lighting. This condition relates to the cells or batteries 12.

The automatic cutting-in in loops, until the flash-light is completely extinguished, of the test of the power remaining in the cells or batteries 12 symbolised by the flashing or non-flashing display of the bar graph pictogram 36 on the screen 30, indicating whether the level of power remaining in the cells or batteries 12 supplying the bulb of the main lighting is less than 5%. This condition relates to the warning of the rapid end of the main lighting ensured by the bulb 9 and of the imminent changeover to emergency lighting 22, 28, 29.

The automatic cutting-in in loops, until the flash-light is completely extinguished, of the test of the power remaining in the emergency batteries 20 of the emergency lighting 22, 28, 29, symbolised by the display or lack of display of the bar graph pictogram 33 on the screen 30, indicating in 20% blocks the level of power remaining in the emergency batteries of the emergency lighting 22, 28, 29.

The automatic cutting-in in loops, until the flash-light is completely extinguished, of the emergency lighting and the stopping of the current mode of operation, that is to say in the case where one or more of the tests carried out are negative, causing the extinction of the bulb 9 of the main lighting and of its representation by the pictogram 31 as well as the extinction of the bar graph pictogram 36 indicating from then on the lack of direct power consumption via the cells or batteries 12, as well as the illumination of the emergency lighting composed at the front of a series of micro-lamps referenced 28, 29 and a small bulb (micro torch style) positioned at the rear, referenced 22, thus forming the emergency lighting 22, 28, 29, and the permanent illumination of its graphic representation by the pictograms 32A, 32, 32C on the screen 30, preferably displayed using liquid crystals. This condition relates to the changeover to emergency lighting.

The automatic cutting-in in loops, until the flash-light is completely extinguished, of the test of the power remaining in the emergency batteries 20 symbolised by the flashing or non-flashing display of the bar graph pictogram 33 on the screen 30, preferably using liquid crystals, indicating whether the level of power remaining in the emergency batteries 20 supplying the emergency lighting 22, 28, 29 is less than 5%. This condition relates to the warning of imminent and complete extinction of the flash-light.

Description of the Ambient mode of operation:

Two presses for example exerted on the control membrane 27 will permit the starting of the lamp and thus inter alia the changeover to the Ambient mode of operation. This means the starting of the main lighting of the bulb 9 supplied by the cells or batteries 12 and the illumination of the emergency lighting which from then on becomes ambient, composed at the front of a series of micro-lamps referenced 28, 29 and a small bulb (micro torch style) positioned at the rear, referenced 24, thus forming the emergency lighting renamed ambient lighting 22, 28, 29 and the permanent illumination of its graphic representation by the pictograms 32A, 32B, 32C of the screen 30 preferably displayed using liquid crystals. This condition relates to the changeover to Ambient lighting, which will give rise to the automatic cutting-in of a succession of tests and of the managing system. This will cause the display or lack of display of the results in the form of pictograms 31, 32, 32A, 32B, 32C, 33, 34, 35, 36, 37 on the pictogram 38 representing a symbolic view of the flash-light which will itself be a screen-printing on the screen 30, preferably displayed using liquid crystals.

In the course of operating in Ambient mode, various tests constituting the test procedure will be carried out and will give rise to the corresponding displays according to the same mode of operation as for normal use.

Morse mode of operation:

Three presses for example exerted on the control membrane 27 permit the starting of the lamp and thus inter alia the changeover to Morse mode of operation, that is to say the starting of the main lighting of the bulb 9 supplied by the cells or batteries 12 when one or more presses exerted on the control membrane 27 permit the starting of the bulb 9 of the main lighting in intermittent mode as well as the display of its graphic representation pictogram 31 with every other line masked. This condition relates to the changeover to Morse lighting, which will give rise to the automatic cutting-in of a succession of tests and of the managing system. This will cause the display or lack of display of the results in the form of pictograms 31, 32, 32A, 32B, 32C, 33, 34, 35, 36, 37, on the pictogram 38, representing a symbolic view of the flash-light which will itself be a screen-printing on the screen 30, preferably displayed using liquid crystals.

In the course of operating in Morse mode various tests constituting the test procedure will be carried out and will give rise to the corresponding displays according to the same mode of operation as for the normal or the ambient mode of operation.

What is claimed is:

1. A flashlight, comprising:

a body including an end portion, a control membrane, a display, and emergency lighting;

an optical unit disposed within said body end portion, said optical unit having a reflector with a focus, a main bulb disposed substantially at said focus, said reflector adjustable with respect to said main bulb;

at least one primary battery contained within said body and connectable to said main bulb;

at least one rechargeable secondary battery contained within said body and connectable to said emergency lighting; and a managing electronic circuit, comprising:

means for monitoring and displaying a charge level of said primary battery, and for connecting said secondary battery to said emergency lighting if said charge level of said primary battery is insufficient to illuminate said main bulb;

means for monitoring said main bulb and displaying one of an "in order" and an "out of order" condition of said main bulb; and means for monitoring a charge level of said secondary battery and for connecting said secondary battery to said primary battery to recharge said secondary battery if said charge level of said secondary battery is below a threshold level, said means disconnecting said secondary battery from said primary battery when said charge level of said secondary battery is above said threshold level.

2. The flashlight of claim 1, wherein said control membrane is operably connected to one of a contactless Hall effect switch and a lamellar switch.

3. The flashlight of claim 1, wherein said body includes an elongated projection, said projection permanently containing said secondary battery and said emergency lighting.

4. The flashlight of claim 3, wherein said emergency lighting includes an emergency bulb, and said projection includes one of a transparent and a translucent cover disposed over said emergency bulb.

5. The flashlight of claim 1, wherein said body includes a control portion integrated therein and disposed behind said optical unit, said control portion including said managing electronic circuit, said display, and said control membrane.

6. The flashlight of claim 1, wherein a varying number of depressions of said control membrane changes operation of said managing electronic circuit between modes of operation comprising:

a normal use mode, wherein said main bulb is illuminated;

an ambient mode, wherein said main bulb and said emergency lighting are illuminated; and a Morse mode, wherein illumination of said main bulb is selectively interruptible.

* * * * *